US006439379B2

(12) United States Patent
Taormina

(10) Patent No.: US 6,439,379 B2
(45) **Date of Patent: *Aug. 27, 2002**

(54) MULTI-PURPOSE EYEGLASS HOLDING AND CLEANING KIT

(76) Inventor: David Taormina, 20665 Seneca Dr., Clinton Township, MI (US) 48036

( * ) Notice: Subject to any disclaimer, the term of this patent is extended or adjusted under 35 U.S.C. 154(b) by 0 days.

This patent is subject to a terminal disclaimer.

(21) Appl. No.: 09/754,742

(22) Filed: Jan. 4, 2001

Related U.S. Application Data

(63) Continuation-in-part of application No. 09/466,115, filed on Dec. 17, 1999, now Pat. No. 6,170,651.

(51) Int. Cl.[7] ..... A45C 11/04
(52) U.S. Cl. ..... 206/5; 206/229
(58) Field of Search ..... 206/5, 6, 223, 206/229, 494, 38, 581; 221/45, 96

(56) References Cited

U.S. PATENT DOCUMENTS 3,113,579 A * 12/1963 Willis ..... 134/145
4,951,811 A * 8/1990 Lines ..... 150/117
4,960,208 A * 10/1990 Tempke ..... 206/38
5,344,002 A * 9/1994 Baczkowski ..... 15/214
5,439,104 A * 8/1995 Wolska-Klis ..... 206/233
5,526,924 A * 6/1996 Klutznick ..... 206/5
5,803,244 A * 9/1998 Shefler et al. ..... 206/5
D406,696 S * 3/1999 Conway ..... D3/265
5,921,383 A * 7/1999 Shefler et al. ..... 206/38
6,170,651 B1 * 1/2001 Taormina ..... 206/229

* cited by examiner

*Primary Examiner*—David T. Fidei
(74) *Attorney, Agent, or Firm*—Gifford, Krass, Groh, Sprinkle, Anderson & Citkowski, P.C.

(57) ABSTRACT

A multi-purpose eyeglass holding and cleaning kit capable of storing a pair of eyeglasses and including a body with an outer shell constructed of a durable material, the body having a selected length, width and thickness which defines a generally elongate article with a first end and a second end and defining, in combination, a hollow interior suitable for receiving in inserting fashion the pair of the eyeglasses. A hingedly secured portion is secured to the body at a desired location and is actuated from a closed position to an open position in order to reveal an interior of the shell interior and to permit the insertion or removal of the pair of eyeglasses. A volume of a glass lens cleaning solution is contained within the shell at a selected location, the cleaning solution further including a dispensing pump incorporated within the body. A flap defined on an inner face of the shell interior supports a fabric material is contained within the shell. When the pair of eyeglasses are removed from the body, the dispensing pump is employed in a first step to apply cleaning solution to the surfaces of the eyeglass lenses and the fabric material is removed from the flap and employed in a second step to wipe dry the solution from the cleaned lenses.

9 Claims, 2 Drawing Sheets

MULTI-PURPOSE EYEGLASS HOLDING AND CLEANING KIT

CROSS REFERENCE TO RELATED APPLICATIONS

The present application is a continuation-in-part of U.S. application Ser. No. 09/466,115, filed Dec. 17, 1999, now U.S. Pat. No. 6,170,651 for a MULTI-PURPOSE EYEGLASS HOLDING AND CLEANING KIT.

FIELD OF THE INVENTION

The present invention relates generally to eyeglass carrying and storage cases, as well as to eyeglass cleaning devices and, more particularly, to a combination and multi-purpose eyeglass holding and cleaning kit.

DESCRIPTION OF THE PRIOR ART

Eyeglass holding cases and eyeglass cleaning devices are by themselves very well known in the art. Numerous types and constructions of eyeglass holding sleeves constructed of soft vinyl and leather are known, as are hardened shell cases typically constructed of polymerized materials.

Some attempts have been made in the prior art to combine the features of eyeglass holding and eyeglass cleaning/polishing devices. A notable example of this is set forth in U.S. Pat. No. 5,344,002, issued to Baczkowski, and which discloses a combination eyeglass lens polisher and holder device. The device of Baczkowski includes the provision of an elongated, flexible and resilient bottom strip having opposite ends, a bottom surface and an opposite upper surface. The bottom surface is constructed of a flexible and non-abrasive surface and is adapted for polishing the glasses lens. A pair of flexible, resilient eyeglass holder pockets are secured to the upper surface of the bottom strip adjacent its opposite ends and are spaced apart to define a central foldable portion therebetween. The pockets hold a pair of eyeglasses, with each lens contained within an associated pocket. The eyeglasses are polished upon being removed from the pockets, by inserting the thumb into one pocket, the forefinger and middle finger of the same hand into the other pocket, folding the device around the central foldable portion, and embracing the selected eyeglass lens between to polish it by applying kneading action of the non-abrasive surfaces against each of the lenses in succession.

Although providing an interesting example of carrying a pair of eyeglasses in a soft, flexible covering member, the device of Baczkowski does not provide any level of durable and crush-resistant protection to the eyeglasses held within and further does not provide any form of a fluid wetting/cleaning solution. The non-abrasive opposing surfaces defined upon the Baczkowski pockets are further inapplicable in combination with a suitable spray or wetting solution which has been found to be most effective for cleaning eyeglass lenses.

A further example of a combined eyeglass and contact lens and accessories case is illustrated in U.S. Pat. No. 4,951,811, issued to Lines. The Lines patent discloses combining the glasses with a contact lens case, a first wetting solution bottle, and a second cleaning solution bottle. As illustrated, the carrying case may be folded upon itself through the use of Velcro strips. A small rectangular mirror is glued to the fabric material along one inwardly facing surface as illustrated.

As with Baczkowski, the Lines patent is likewise directed to a flexible carrying case. Further, wetting and cleaning solution bottles are disclosed as being directed for use with the contact lenses and no provision is made for employing either or both without first removing them from within associated pockets formed in the fabric material.

SUMMARY OF THE PRESENT INVENTION

The present invention is a novel and useful multi-purpose eyeglass holding and cleaning kit which is capable of storing a pair of eyeglasses in a convenient and secure fashion, as well as providing the ability to quickly remove and clean the eyeglasses using both a fluid cleaning solution and one or more non-abrasive lens tissue wipes.

According to a first preferred embodiment, the body is constructed with an outer shell of a durable material. The body is shaped so as to form a generally smooth edged and elongated article with a selected length, width and thickness defined by first and second flattened faces, a first extending side and a second extending side and which defines a generally elongate article with a hollow interior suitable for receiving a pair of eyeglasses.

The first face further defines a lid pivotally secured along an axially extending edge of the body and being actuated from a closed position to an open position to reveal a hollow interior suitable for receiving in inserting fashion a pair of eyeglasses. The hingedly secured lid includes an inner face and within which is positioned a flap for holding a fabric material.

A volume of a glass cleaning solution is contained within the shell of the body and, in one particular variant of the first preferred embodiment, includes a dispensing pump mechanism with a depressible spray head. A portion of the hingedly secured lid is configured to reveal the dispensing pump when the lid is actuated to the closed position. An externally viewable and transparent fluid measuring window is provided along an insertable and affixable fluid carrying unit within which the cleaning solution is held.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
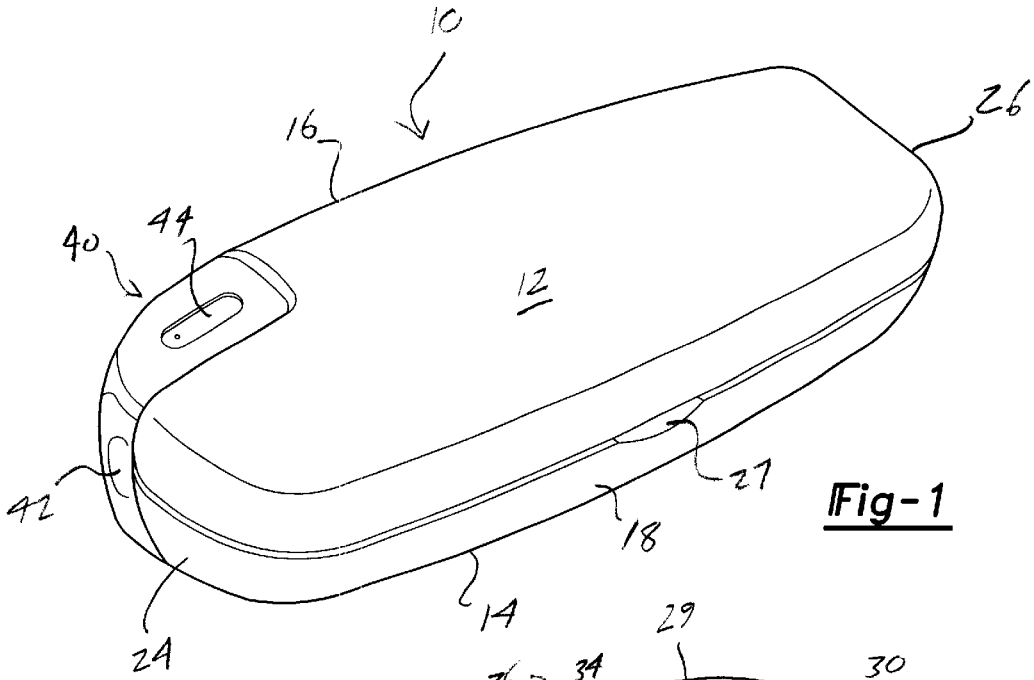
FIG. 1 is a perspective view of the multi-purpose eyeglass holding and cleaning kit according to the preferred embodiment of the present invention.
Figure 2:
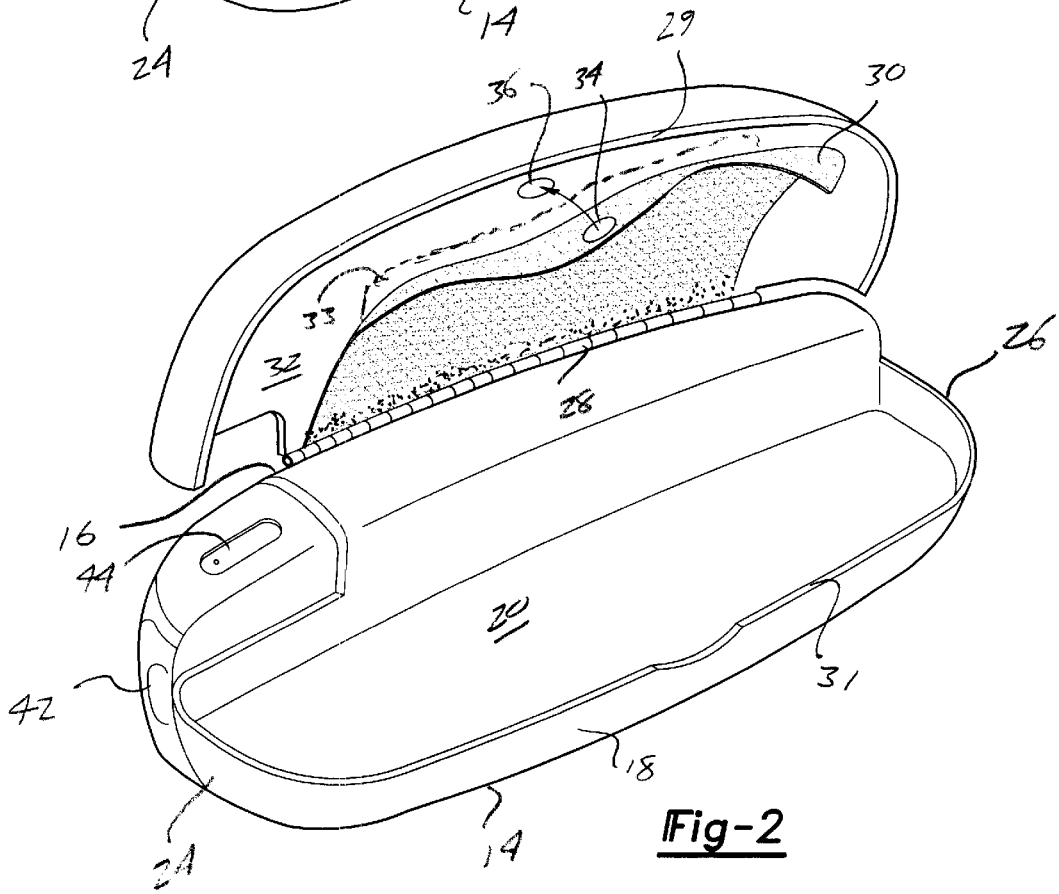
FIG. 2 is a further perspective view of the eyeglass holding and cleaning kit illustrated in FIG. 1 and further showing the axially secured lid actuated to an open position to reveal the eyeglass holding interior.

Referring now to FIGS. 1 and 2, a perspective view is shown at 10 of a multi-purpose eyeglass holding and cleaning kit according to the first preferred embodiment of the present invention. A body of the kit is constructed with an outer shell of a durable material, and particularly a plasticized or vinyl material or a combination of both. The body according to the preferred embodiment further has a selected length, width and thickness defined by a first generally flattened face 12 and a second generally flattened face 14.

Figure 4:
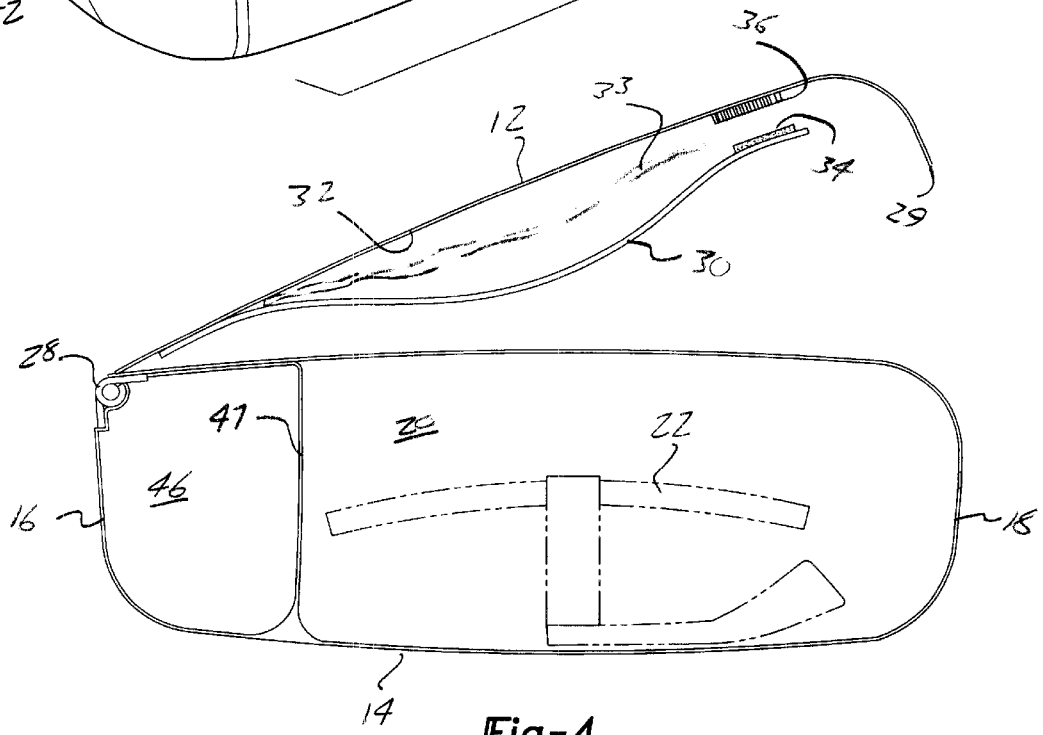
FIG. 4 is a cross sectional view of the eyeglass holding and cleaning kit and illustrating the eyeglass holding compartment and cleaning solution subcompartment.

The body further includes a first elongate, axial extending and generally arcuate side 16 and a second opposite and likewise extending side 18 combined with the first and second generally flattened faces 12 and 14 to define a generally elongate article with a hollow interior 20 (see FIG. 2) suitable for receiving in inserting fashion the pair of eyeglasses 22 (see also cross sectional cutaway of FIG. 4). The body further has a first end 24 and a second end 26.

Figure 3:
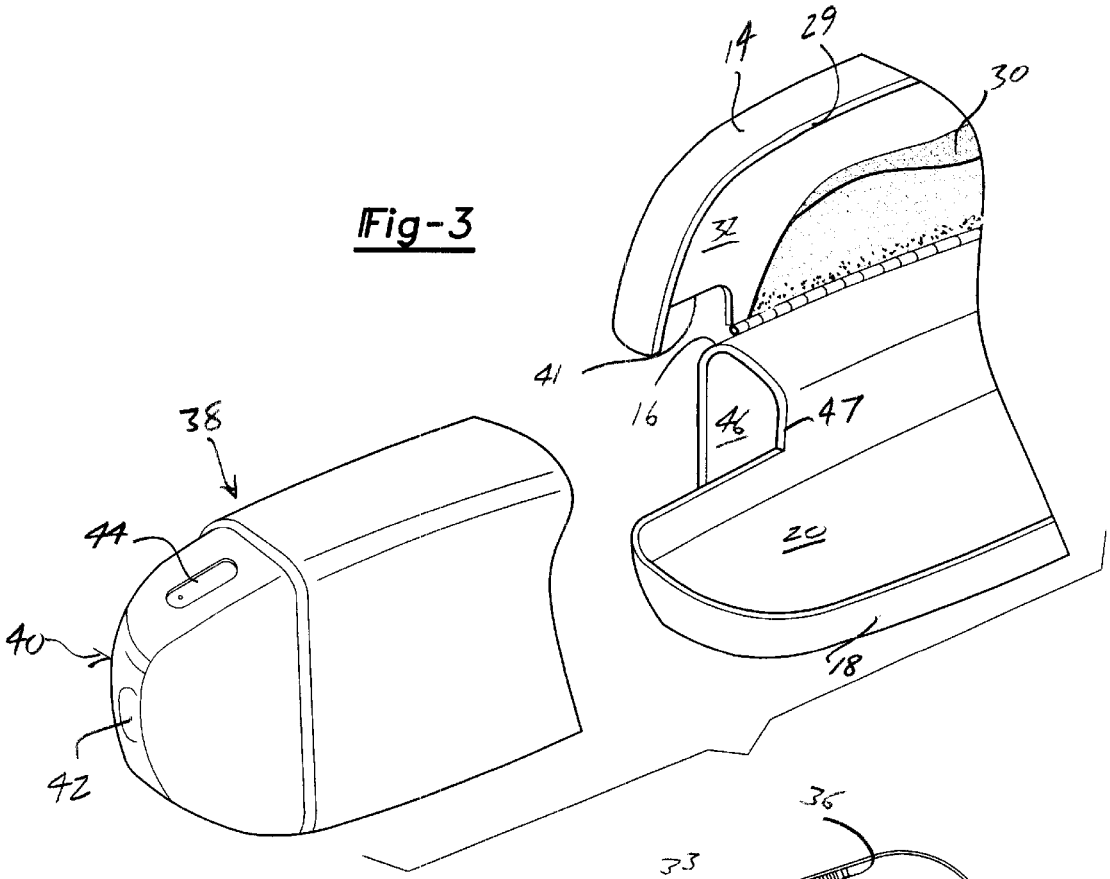
FIG. 3 is a view similar to that shown in FIG. 2 and illustrating, in enlarged section, the removable nature of the fluid carrying unit according to one preferred variant of the present invention.

The first generally flattened face 12, in the preferred variant, defines a hingedly secured lid and which is actuated from a closed position (as shown in FIG. 1) to an open position (as best seen in FIGS. 2 and 3) by a conventional latch 27 to reveal the interior 20 of the body shell and to permit the insertion or removal of the pair of eyeglasses 22. The hingedly secured face 12 is biasingly opened and closed along a hinged edge 28 (this typically being defined by an elongated and coil-type spring element) and which influences the lid/face 12 in either opening or closing directions as is known in the art and depending upon a selected actuating force being applied to the lid. Also, the lid/first face 12 terminates in a curved edge 29 which encloses over an abutting edge 31 of the extending side 18 of the body.

A flap 30 is secured to an inner face 32 of the lid and supports a suitable cloth or other fabric insert (see at 33) for cleaning the lens surfaces of the eyeglasses 22. In a preferred variant, interengaging portions 34 and 36 (and such as which may include Velcro® portions) are arranged between the flap 30 and the inner face 32 to maintain the flap 30 and interdisposed cloth in place. It is also understood that the provision of the flap 30 is optional and that the multi-purpose eyeglass holding and cleaning kit may function without the flap 30 or any otherwise secured fabric material.

A volume of a glass lens cleaning solution is contained within the shell and is provided as an insertable and affixable unit 38 within which the volume of cleaning solution is held. As is also illustrated in FIGS. 2 and 3 the fluid solution unit 38 includes a dispensing pump 40. A portion of the first face 12 is configured, at 41, to permit the dispensing pump 40 to be visible upon said unit 38 being affixed within the shell body and the hinged face 12 being actuated to the closed position.

A depressible portion 42 is provided at a selected location of the pump 40 for actuating the pump. The dispensing pump 40 further includes a spray nozzle 44 which, upon inwardly actuating the dispensing pump, causes a fine mist spray to be issued. Referring further to FIG. 3, the unit 38 is illustrated in exploded fashion and also evident is the axially extending and subdivided compartment 46 defined within the interior 20 of the shell body (by interior dividing wall 47) and which permits installation of the unit 38.

It is also envisioned that the fluid carrying capability of the unit can be provided by an integrally defined subcompartment within the body and which is directly refilled without the need for a separately installable spray application unit. In such an instance, an attachable spray head (not shown) with fluid withdrawing stem (again not shown) is attachable to the fluid carrying subcompartment.

Having described my invention, it will be apparent that it discloses a novel and useful multi-purpose eyeglass holding and cleaning kit which is a significant improvement over that taught by the prior art. Additional embodiments will become apparent to those skilled in the art to which it pertains without deviating from the scope of the appended claims. Specifically, the elongate and three-dimensional body can be provided as first and second telescoping and axially adjustable tubes and so as to establish an overall length of the body to accommodate different sized eyeglasses. Additionally, the glass cleaning fluid can be incorporated and applied in additional variations beyond those specifically disclosed, such as being held entirely within a selected three-dimensional hingedly secured portion attached to either a selected end or a selected flattened face of the body.

I claim:

1. A multi-purpose eyeglass holding and cleaning kit capable of storing a pair of eyeglasses, said eyeglass holding and cleaning kit comprising:

a body with an outer shell constructed of a durable material, said body having a selected length, width and thickness which defines a generally elongate article with a hollow interior suitable for receiving in inserting fashion the pair of eyeglasses;

said body further including a hingedly secured portion which is actuated from a closed position to an open position in order to reveal said hollow interior of said shell and to permit the insertion or removal of the pair of eyeglasses; and a volume of a glass lens cleaning solution contained within said shell, said cleaning solution further including a dispensing pump;

whereupon, when the pair of eyeglasses are removed from said body, said cleaning solution is applied to the surfaces of the eyeglass lenses, a fabric material is employed to wipe dry the solution from the cleaned lenses.

2. The multi-purpose eyeglass kit according to claim 1, said hingedly secured portion further comprising a lid pivotally secured along an axially extending edge of said body.

3. The multi-purpose eyeglass kit according to claim 2, further comprising a flap securing to an inner face of said lid and securing in place a cloth insert.

4. The multi-purpose eyeglass kit according to claim 1, said cleaning solution further comprising an insertable and affixable fluid carrying unit within which said volume of cleaning solution is held, a dispensing pump being visible upon inserting said fluid carrying unit into an associating recess defined within said body.

5. The multi-purpose eyeglass kit according to claim 4, further comprising a depressible portion for actuating said dispensing pump.

6. The multi-purpose eyeglass kit according to claim 4, said hingedly secured portion further comprising a lid pivotally secured along an axially extending edge of said body, a portion of said lid being configured to reveal said dispensing pump when said lid is actuated to a closed position.

7. The multi-purpose eyeglass kit according to claim 1, said body further comprising an integrally formed and axially extending subcompartment within which said volume of cleaning solution is held.

8. The multi-purpose eyeglass kit according to claim 7, said generally elongate extending body further comprising first and second substantially flattened faces, a first extending side and a second opposite extending side, a first end and a second end, said integrally formed and fluid holding subcompartment being defined in proximity to a selected extending side between said first end and said second end.

9. A multi-purpose eyeglass holding and cleaning kit capable of storing a pair of eyeglasses, said eyeglass holding and cleaning kit comprising:

a body with an outer shell constructed of a durable material, said body having a selected length, width and thickness defined by first and second flattened faces, a first extending side and a second extending side and which defines a generally elongate article with a hollow interior suitable for receiving in inserting fashion the pair of eyeglasses, said body further having a first end and a second end;

said first face being defined by a lid pivotally secured along an axially extending edge of said body and which is actuated from a closed position to an open position in order to reveal an interior of said shell and to permit the insertion or removal of the pair of eyeglasses;

said lid further including an inner face defining a flap within which is held a fabric material;

a volume of a glass lens cleaning solution being contained within said shell, said cleaning solution further including a dispensing pump incorporated within said body, a portion of said lid being configured to reveal said dispensing pump when said lid is actuated to a closed position; and whereupon, when the pair of eyeglasses are removed from said body, said dispensing pump is employed in a first step to apply cleaning solution to the surfaces of the eyeglass lenses, said fabric material wiping dry the solution from the cleaned lenses.

* * * * *